US007722691B2

(12) United States Patent
Orlhac et al.

(10) Patent No.: US 7,722,691 B2
(45) Date of Patent: May 25, 2010

(54) ABRASIVE TOOLS HAVING A PERMEABLE STRUCTURE

(75) Inventors: Xavier Orlhac, Holden, MA (US); Muthu Jeevanantham, Worcester, MA (US); Russell Krause, Shrewsbury, MA (US); Mianxue Wu, Suwanee, GA (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 0 days.

(21) Appl. No.: 11/240,809

(22) Filed: Sep. 30, 2005

(65) Prior Publication Data

US 2007/0074456 A1 Apr. 5, 2007

(51) Int. Cl.
*B24D 3/02* (2006.01)
*C09C 1/68* (2006.01)
*C09K 1/14* (2006.01)

(52) U.S. Cl. ..... 51/309; 51/307; 51/308; 264/115; 264/122

(58) Field of Classification Search ..... 51/307–309, 51/298, 296; 264/115, 122
See application file for complete search history.

(56) References Cited

U.S. PATENT DOCUMENTS

| | | | |
|---|---|---|---|
| 2,216,728 | A | 10/1940 | Benner et al. |
| 3,048,482 | A | 8/1962 | Hurst |
| 3,323,885 | A | 6/1967 | Rowse et al. |
| 3,916,584 | A | 11/1975 | Howard et al. |
| 3,955,324 | A | 5/1976 | Lindstrom |
| 3,982,359 | A | 9/1976 | Elbel et al. |
| 4,024,675 | A | 5/1977 | Naidich et al. |
| 4,239,503 | A | 12/1980 | Harris et al. |
| 4,311,489 | A | 1/1982 | Kressner |
| 4,314,827 | A | 2/1982 | Leitheiser et al. |
| 4,393,021 | A | 7/1983 | Eisenberg et al. |
| 4,486,200 | A | 12/1984 | Heyer et al. |
| 4,541,842 | A | 9/1985 | Rostoker |
| 4,543,107 | A | 9/1985 | Rue |
| 4,575,384 | A | 3/1986 | Licht et al. |
| 4,623,364 | A | 11/1986 | Cottringer et al. |
| 4,652,275 | A | 3/1987 | Bloecher et al. |
| 4,671,017 | A | 6/1987 | Ideue et al. |
| 4,744,802 | A | 5/1988 | Schwabel |
| 4,770,671 | A | 9/1988 | Monroe et al. |
| 4,799,939 | A | 1/1989 | Bloecher et al. |
| 4,881,951 | A | 11/1989 | Monroe et al. |
| 4,898,597 | A | 2/1990 | Hay et al. |
| 5,011,508 | A | 4/1991 | Wald et al. |
| 5,039,311 | A | 8/1991 | Bloecher |
| 5,094,672 | A | 3/1992 | Giles, Jr. et al. |
| 5,095,665 | A | 3/1992 | Nagata et al. |
| 5,096,465 | A | 3/1992 | Chen et al. |
| 5,127,197 | A | 7/1992 | Brukvoort et al. |
| 5,129,189 | A | 7/1992 | Wetscher |
| 5,129,919 | A | 7/1992 | Kalinowski et al. |
| 5,131,926 | A | 7/1992 | Rostoker et al. |
| 5,178,644 | A | 1/1993 | Huzinec |
| 5,194,072 | A | 3/1993 | Rue et al. |
| 5,203,886 | A | 4/1993 | Sheldon et al. |
| 5,213,591 | A | 5/1993 | Celikkaya et al. |
| 5,244,477 | A | 9/1993 | Rue et al. |
| 5,273,558 | A | 12/1993 | Nelson et al. |
| 5,372,620 | A | 12/1994 | Rowse et al. |
| 5,383,945 | A | 1/1995 | Cottringer et al. |
| 5,395,407 | A | 3/1995 | Cottringer et al. |
| 5,401,284 | A | 3/1995 | Sheldon et al. |
| 5,429,647 | A | 7/1995 | Larmie |
| 5,429,648 | A | 7/1995 | Wu |
| 5,489,204 | A | 2/1996 | Conwell et al. |
| 5,500,273 | A | 3/1996 | Holmes et al. |
| 5,536,283 | A | 7/1996 | Sheldon et al. |
| 5,551,963 | A | 9/1996 | Larmie |
| 5,607,489 | A | 3/1997 | Li |
| 5,649,984 | A | 7/1997 | Sigalas et al. |
| 5,651,729 | A | 7/1997 | Benguerel |
| 5,651,801 | A | 7/1997 | Monroe et al. |
| 5,711,774 | A | 1/1998 | Sheldon |

(Continued)

FOREIGN PATENT DOCUMENTS

| | | |
|---|---|---|
| GB | 1 228 319 | 4/1971 |

(Continued)

OTHER PUBLICATIONS

"Altos High Performance Ceramic Aluminum Oxide Grinding Wheels" Jun. 2002.

(Continued)

*Primary Examiner*—Anthony J Green
*Assistant Examiner*—Pegah Parvini
(74) *Attorney, Agent, or Firm*—Mike W. Crosby

(57) ABSTRACT

A bonded abrasive tool comprises a blend of abrasive grains and a bond component. The blend of abrasive grains comprises a filamentary sol-gel alumina abrasive grain and agglomerated abrasive grain granules. A bonded abrasive tool comprising an agglomerate of filamentary sol-gel alumina abrasive and non-filamentary abrasive grains, and a bond component is also disclosed. The filamentary sol-gel alumina abrasive grain has a length-to-cross-sectional-width aspect ratio of greater than 1.0. The agglomerated abrasive grain granules comprise a plurality of abrasive grains held in a three-dimensional shape by a binding material. A method of making such a bonded abrasive tool as described above is also disclosed.

15 Claims, 1 Drawing Sheet

U.S. PATENT DOCUMENTS

| | | | | |
|---|---|---|---|---|
| 5,738,695 | A | | 4/1998 | Harmer et al. |
| 5,738,696 | A | * | 4/1998 | Wu ..... 51/296 |
| 5,738,697 | A | | 4/1998 | Wu et al. |
| 5,779,743 | A | | 7/1998 | Wood |
| 5,827,337 | A | | 10/1998 | Keil |
| 5,849,052 | A | | 12/1998 | Barber, Jr. |
| 5,863,308 | A | | 1/1999 | Qi et al. |
| 5,975,988 | A | | 11/1999 | Christianson |
| 5,976,204 | A | | 11/1999 | Hammarstrom et al. |
| 6,015,338 | A | | 1/2000 | Hong et al. |
| 6,074,278 | A | | 6/2000 | Wu et al. |
| 6,083,622 | A | | 7/2000 | Garg et al. |
| 6,086,467 | A | | 7/2000 | Imai et al. |
| 6,086,648 | A | | 7/2000 | Rossetti, Jr. et al. |
| 6,102,789 | A | | 8/2000 | Ramanath et al. |
| 6,136,288 | A | | 10/2000 | Bauer et al. |
| 6,217,413 | B1 | | 4/2001 | Christianson |
| 6,251,149 | B1 | | 6/2001 | Meyer et al. |
| 6,319,108 | B1 | | 11/2001 | Adefris et al. |
| 6,354,929 | B1 | | 3/2002 | Adefris et al. |
| 6,361,403 | B1 | | 3/2002 | Kuramochi et al. |
| 6,394,888 | B1 | | 5/2002 | Matsumoto et al. |
| 6,609,963 | B2 | | 8/2003 | Li et al. |
| 6,679,758 | B2 | | 1/2004 | Bright et al. |
| 6,702,650 | B2 | | 3/2004 | Adefris |
| 6,797,023 | B2 | | 9/2004 | Knapp et al. |
| 2003/0194947 | A1 | | 10/2003 | Bright et al. |
| 2003/0194954 | A1 | | 10/2003 | Bonner et al. |
| 2005/0026553 | A1 | | 2/2005 | Bonner et al. |
| 2005/0101225 | A1 | | 5/2005 | Bright et al. |

FOREIGN PATENT DOCUMENTS

| | | | | |
|---|---|---|---|---|
| GB | 1 418 730 | | | 12/1975 |
| WO | WO 96/10471 | | | 4/1996 |
| WO | WO 98/03306 | | | 1/1998 |
| WO | 98/04385 | A1 | | 2/1998 |
| WO | 98/04386 | A1 | | 2/1998 |
| WO | WO 00/51788 | | | 9/2000 |
| WO | WO 01/04227 | A2 | | 1/2001 |
| WO | WO 01/83166 | A1 | | 11/2001 |
| WO | WO 01/85393 | A1 | | 11/2001 |
| WO | WO 02/28802 | A2 | | 4/2002 |
| WO | WO 03/086703 | | * | 10/2003 |
| WO | WO 03/086703 | A1 | | 10/2003 |

OTHER PUBLICATIONS

International Preliminary Report on Patentability and Written Opinion from International Application No. PCT/US2006/033438, filed Aug. 28, 2006, dated Apr. 1, 2008.

French Preliminary Search Report dated May 27, 2008 from corresponding French Patent Application No. 06 08454, filed on Sep. 27, 2006.

* cited by examiner

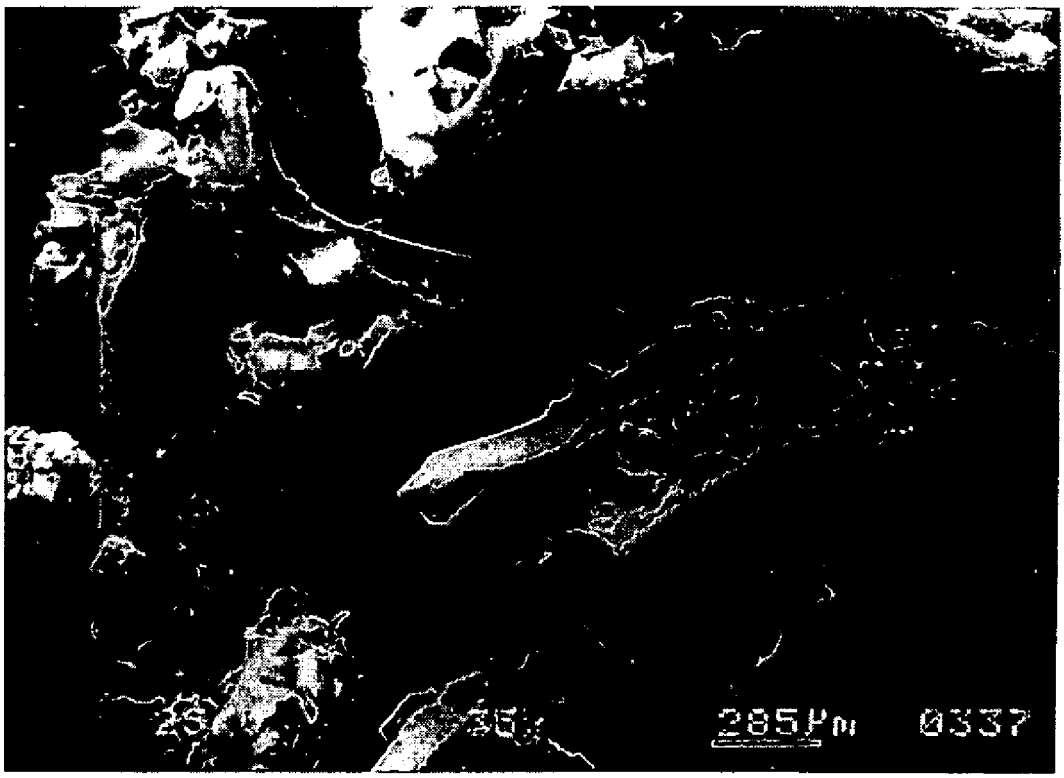
25
35
285μm
0337

ABRASIVE TOOLS HAVING A PERMEABLE STRUCTURE

BACKGROUND OF THE INVENTION

In many grinding operations, grinding tool porosity, particularly porosity of a permeable or an interconnected nature, improves efficiency of the grinding operation and quality of the work-piece being ground. In particular, the volume percent of interconnected porosity or fluid permeability has been found to be a significant determinant of grinding performance of abrasive tools. The interconnected porosity allows removal of grinding waste (swarf) and passage of cooling fluid within the wheel during grinding. Also, the interconnected porosity provides access to grinding fluids such as lubricants between the moving abrasive grains and workpiece surface. These features are particularly important in deep cut and modern precision processes (e.g., creepfeed grinding) for high efficiency grinding where a large amount of material is removed in one deep grinding pass without sacrificing the accuracy of the workpiece dimension.

Examples of such abrasive tools having a very open and permeable structure include abrasive tools utilizing elongated or fiber-like abrasive grains. U.S. Pat. Nos. 5,738,696 and 5,738,697 disclose methods for making bonded abrasives utilizing elongated or fiber-like abrasive grains having an aspect ratio of at least about 5:1. One example of such abrasive tools employing filamentary abrasive grains is currently commercially available under the ALTOS™ trademark from Saint-Gobain Abrasives in Worcester, Mass.

ALTOS™ abrasive tools employ sintered sol gel alumina ceramic grains (Saint-Gobain Abrasives in Worcester, Mass.) with an average aspect ratio of about 7.5:1, such as Norton® TG2 or TGX Abrasives (hereinafter "TG2"), as a filamentary abrasive grain. ALTOS™ abrasive tools are highly porous and permeable grinding tools that have been shown to have high metal removal rates, improved form holding and long wheel life, along with a greatly reduced risk of metallurgical damage (see, for example, Norton Company Technical Service Bulletin, June 2002, "Altos High Performance Ceramic Aluminum Oxide Grinding Wheels"). ALTOS™ abrasive tools use abrasive grains that include only the filamentary abrasive grain, e.g., TG2 grain, to achieve maximum structural openness according to fiber-fiber packing theories (see, for example, U.S. Pat. Nos. 5,738,696 and 5,738,697, the entire contents of which are hereby incorporated by reference). It is generally believed that blending TG2 grain with a significant quantity of other non-filamentary, such as sphere-like, grains would either compromise the structural openness or compromise surface finish of a metal workpiece. However, TG2 grains, although very durable, are not friable enough for certain applications and TG2 grain is more costly to manufacture than most blocky or sphere shaped grains.

Therefore, there is a need to develop a more friable, more cost effective abrasive tool having performance characteristics similar to the performance of abrasive tools employing filamentary abrasive grains, such as ALTOS™ abrasive tools.

SUMMARY OF THE INVENTION

It has now been discovered that bonded abrasive tools made with a blend of a filamentary sol-gel alumina abrasive grain or an agglomerate thereof, and agglomerated abrasive grain granules can have improved performance relative to those made with 100% of either filamentary sol-gel alumina abrasive grain, or agglomerated abrasive grain granules. For example, Applicants have found that bonded abrasive tools incorporating a blend of TG2 or an agglomerate of TG2, and agglomerated alumina-abrasive grain granules, have a highly porous and permeable structure, and show excellent performance in various grinding applications without compromising surface-finish quality. Based on this discovery, an abrasive tool comprising a blend of a filamentary sol-gel alumina abrasive grain, or an agglomerate thereof, and agglomerated abrasive grain granules, and a method of producing such an abrasive tool are disclosed herein. An abrasive tool comprising an agglomerate of filamentary sol-gel alumina abrasive grain and a method of producing such an abrasive tool are also disclosed herein.

In one embodiment, the present invention is directed to a bonded abrasive tool comprising a blend of abrasive grains, a bond component and at least about 35 volume percent porosity. The blend of abrasive grains includes a filamentary sol-gel alumina abrasive grain, or an agglomerate thereof, and agglomerated abrasive grain granules. The filamentary sol-gel alumina abrasive grain has a length-to-cross-sectional-width aspect ratio of greater than about 1.0. The agglomerated abrasive grain granules include a plurality of abrasive grains held in a three-dimensional shape by a binding material.

In another embodiment, the invention is directed to a bonded abrasive tool comprising an agglomerate that includes a filamentary sol-gel alumina abrasive grain, a non-filamentary abrasive grain and a binding material; a bond component; and at least about 35 volume percent porosity. The non-filamentary abrasive grain and filamentary sol-gel alumina abrasive grain are held in a three-dimensional shape by the binding material.

The present invention also includes a method of making a bonded abrasive tool. In the method, a blend of abrasive grains is formed, where the blend includes a filamentary sol-gel alumina abrasive grain, or an agglomerate thereof, and agglomerated abrasive grain granules, as described above. The blend of abrasive grains is then combined with a bond component. The combined blend of abrasive grains and bond component is molded into a shaped composite including at least about 35 volume percent porosity. The shaped composite of the blend of abrasive grains and bond component is heated to form the bonded abrasive tool.

The invention can achieve the desired performance without compromising surface-finish quality or structural openness of the resultant product. Abrasive tools employing a blend of filamentary sol-gel alumina abrasive grain, or an agglomerate thereof, and agglomerated abrasive grain granules, can form a fiber-fiber network and at the same time form a non-fiber network, such as a pseudo-sphere-sphere network, in the same structure. The abrasive tools of the invention, such as an abrasive wheel, have a porous structure that is highly permeable to fluid flow, and have outstanding grinding performance with high metal removal rates. Performance of the abrasives tools of the invention can be tailored to grinding applications by adjusting grain blend contents to maximize either friability or toughness or to balance the two. High permeability of the abrasive tools of the invention is particularly advantageous in combination with high metal removal rates, minimizing heat generation in the grinding zone, and thus making wheel life longer and reducing risk of metallurgical damage.

BRIEF DESCRIPTION OF THE DRAWINGS

The FIGURE is a scanning electron microscopy (SEM) picture of the agglomerate of 75% of Norton® TG2 abrasive and 25% of Norton® 38A abrasive grains for a bonded abrasive tool of the invention.

DETAILED DESCRIPTION OF THE INVENTION

The foregoing and other objects, features and advantages of the invention will be apparent from the following more particular description of preferred embodiments of the invention, as illustrated in the accompanying drawings.

A bonded abrasive tool of the present invention has a very open, permeable structure having interconnected porosity. The bonded abrasive tool has at least about 35% porosity, preferably about 35% to about 80% porosity by volume of the tool. In a preferred embodiment, at least about 30% by volume of the total porosity is interconnected porosity. Therefore, the bonded abrasive tools of the invention have high interconnected porosity, and are particularly suitable for deep cut and modern precision processes, such as creepfeed grinding. Herein, the term "interconnected porosity" refers to the porosity of the abrasive tool consisting of the interstices between particles of bonded abrasive grain which are open to the flow of a fluid. The existence of interconnected porosity is typically confirmed by measuring the permeability of the abrasive tool to the flow of air or water under controlled conditions, such as in the test methods disclosed in U.S. Pat. Nos. 5,738,696 and 5,738,697, the entire teachings of which are incorporated herein by reference.

Herein, the term "filamentary" abrasive grain is used to refer to filamentary ceramic abrasive grain having a generally consistent cross-section along its length, where the length is greater than the maximum dimension of the cross-section. The maximum cross-sectional dimension can be as high as about 2 mm, preferably below about 1 mm, more preferably below about 0.5 mm. The filamentary abrasive grain may be straight, bent, curved or twisted so that the length is measured along the body rather than necessarily in a straight line. Preferably, the filamentary abrasive grain for the present invention is curved or twisted.

The filamentary abrasive grain for the present invention has an aspect ratio of greater than 1.0, preferably at least 2:1, and most preferably at least about 4:1, for example, at least about 7:1 and in a range of between about 5:1 and about 25:1. Herein, the "aspect ratio" or the "length-to-cross-sectional-width-aspect ratio" refers to the ratio between the length along the principal or longer dimension and the greatest extent of the grain along any dimension perpendicular to the principal dimension. Where the cross-section is other than round, e.g., polygonal, the longest measurement perpendicular to the lengthwise direction is used in determining the aspect ratio.

Herein the term "agglomerated abrasive grain granules" or "agglomerated grain" refers to three-dimensional granules comprising abrasive grain and a binding material, the granules having at least 35 volume % porosity. Unless filamentary grains are described as making up all or part of the grain in the granules, the agglomerated abrasive grain granules consist of blocky or sphere-shaped abrasive grain having an aspect ratio of about 1.0. The agglomerated abrasive grain granules are exemplified by the agglomerates described in U.S. Pat. No. 6,679,758 B2. The bonded abrasive tools of the invention are made with grain blends comprising filamentary abrasive grain, either in loose form and/or in agglomerated form, together with agglomerated abrasive grain granules comprising blocky or sphere-shaped abrasive grain having an aspect ratio of about 1.0. In an alternative, tools of the invention are made with agglomerated filamentary abrasive grain granules containing blocky or sphere-shaped abrasive grain having an aspect ratio of about 1.0. Each of these tools optionally may include in the grain blend one or more secondary abrasive grains in loose form.

In one embodiment, the blend comprises the filamentary sol-gel alumina abrasive grain and agglomerated abrasive grain granules. In this embodiment, the blend includes about 5-90%, preferably about 25-90%, more preferably about 45-80%, by weight of the filamentary sol-gel alumina abrasive grain with respect to the total weight of the blend. The blend further includes about 5-90%, preferably about 25-90%, more preferably about 45-80%, by weight, of the agglomerated abrasive grain granules. The blend optionally contains a maximum of about 50%, preferably about 25%, by weight of secondary abrasive grain that is neither the filamentary grain, nor the agglomerated grain. The selected quantities of the filamentary grain, the agglomerated grain and the optional secondary abrasive grain total 100%, by weight, of the total grain blend used in the abrasive tools of the invention. Suitable secondary abrasive grains for optionally blending with the filamentary grain and the agglomerated grain are described below.

In another embodiment, the blend comprises an agglomerate of the filamentary sol-gel alumina abrasive grain and the agglomerated abrasive grain granules. The agglomerate of the filamentary sol-gel alumina abrasive grain comprises a plurality of grains of the filamentary sol-gel alumina abrasive grain and a second binding material. The filamentary sol-gel alumina abrasive grains are held in a three-dimensional shape by the second binding material.

Optionally, the agglomerate of the filamentary sol-gel alumina abrasive grain further comprises a secondary abrasive grain. The secondary abrasive grain and filamentary abrasive grain are held in a three-dimensional shape by the second binding material. The secondary abrasive grain can include one or more of the abrasive grains known in the art for use in abrasive tools, such as the alumina grains, including fused alumina, non-filamentary sintered sol-gel alumina, sintered bauxite, and the like, silicon carbide, alumina-zirconia, aluminoxynitride, ceria, boron suboxide, garnet, flint, diamond, including natural and synthetic diamond, cubic boron nitride (CBN), and combinations thereof. Except when sintered sol-gel alumina is used, the secondary abrasive grain can be any shape, including filament-type shapes. Preferably, the secondary abrasive grain is a non-filamentary abrasive grain.

The amount of the filamentary abrasive grain in the agglomerate of the filamentary abrasive grain is typically in a range of about 15-95%, preferably about 35-80%, more preferably about 45-75%, by weight with respect to the total weight of the agglomerate.

The amount of the secondary abrasive grains in the agglomerate of the filamentary abrasive grain is typically in a range of about 5-85%, preferably about 5-65%, more preferably about 10-55%, by weight with respect to the total weight of the agglomerate. As in the case of blends of filamentary grain and agglomerated grain, optional secondary grain may be added to the agglomerated filamentary grain to form the total grain blend used in the abrasive tools of the invention. Once again, a maximum of about 50%, preferably about 25%, by weight, of the optional secondary abrasive grain may be blended with the filamentary grain agglomerate to arrive at the total grain blend used in the abrasive tools.

The filamentary sol-gel alumina abrasive grain includes polycrystals of sintered sol-gel alumina. Seeded or unseeded sol-gel alumina can be included in the filamentary sol-gel alumina abrasive grain. Preferably, a filamentary, seeded sol-gel alumina abrasive grain is used for the blend of abrasive grains. In a preferred embodiment, the sintered sol-gel alumina abrasive grain includes predominantly alpha alumina crystals having a size of less than about 2 microns, more preferably no larger than about 1-2 microns, even more preferably less than about 0.4 microns.

Sol-gel alumina abrasive grains can be made by the methods known in the art (see, for example, U.S. Pat. Nos. 4,623,364; 4,314,827; 4,744,802; 4,898,597; 4,543,107; 4,770,671; 4,881,951; 5,011,508; 5,213,591; 5,383,945; 5,395,407; and 6,083,622, the contents of which are hereby incorporated by reference.) For example, typically they are generally made by forming a hydrated alumina gel which may also contain varying amounts of one or more oxide modifiers (e.g., MgO, $ZrO_2$ or rare-earth metal oxides), or seed/nucleating materials (e.g. $\alpha$-$Al_2O_3$, $\gamma$-$Al_2O_3$, $\alpha$-$Fe_2O_3$ or chromium oxides), and then drying and sintering the gel (see for example, U.S. Pat. No. 4,623,364).

Typically, the filamentary sol-gel alumina abrasive grain can be obtained by a variety of methods, such as by extruding or spinning a sol or gel of hydrated alumina into continuous filamentary grains, drying the filamentary grains so obtained, cutting or breaking the filamentary grains to the desired lengths and then firing the filamentary grains to a temperature of, preferably not more then about 1500° C. Preferred methods for making the grain are described in U.S. Pat. No. 5,244,477, U.S. Pat. No. 5,194,072 and U.S. Pat. No. 5,372,620. Extrusion is most useful for sol or gel of hydrated alumina between about 0.254 mm and about 1.0 mm in diameter which, after drying and firing, are roughly equivalent in diameter to that of the screen openings used for 100 grit to 24 grit abrasives, respectively. Spinning is most useful for filamentary grains sized less than about 100 microns in diameter after firing.

Gels most suitable for extrusion generally have a solid-content of about 30-68%. The optimum solid-content varies with the diameter of the filament being extruded. For example, an about 60% solid-content is preferred for filamentary abrasive grains having a fired diameter roughly equivalent to the screen opening for a 50-grit crushed abrasive grain. If the filamentary sol-gel alumina abrasive grains are formed by spinning, it is desirable to add about 1% to 5% of a non-glass-forming spinning aid, such as polyethylene oxide, to the sol from which the gel is formed in order to impart desirable viscosity and elastic properties to the gel for the formation of filamentary abrasive grains. The spinning aid is burnt out of the filamentary abrasive grains during calcining or firing.

When a filamentary, seeded sol-gel alumina abrasive grain is used for the blend of abrasive grains, during the process of extruding or spinning a sol or gel of hydrated alumina into continuous filamentary grains, an effective amount of a submicron crystalline seed material that promotes a rapid conversion of the hydrated alumina in the gel to very fine alpha alumina crystals is preferably added. Examples of the seed material are as described above.

Various desired shapes can be generated for extruded gel grains by extruding the gel through dies having the shape desired for the cross section of the grains. These can be, for example, square, diamond, oval, tubular, or star-shaped. In general, however, the cross section is round. The initially formed continuous filamentary grains are preferably broken or cut into lengths of the maximum dimension desired for the intended grinding application. After the filamentary gel grains have been shaped as desired, cut or crushed, and dried if needed, they are converted into a final form of abrasive grains by controlled firing. Generally, a temperature for the firing step is in a range of between about 1200° C. and about 1350° C. Typically, firing time is in a range of between about 5 minutes and 1 hour. However, other temperatures and times may also be used. For grains coarser than about 0.25 mm, it is preferred to prefire the dried material at about 400-600° C. from about several hours to about 10 minutes in order to remove the remaining volatiles and bound water which might cause cracking of the grains during firing. Particularly for grains formed from seeded gels, excessive firing quickly causes larger grains to absorb most of all of smaller grains abound them, thereby decreasing the uniformity of the product on a micro-structural scale.

Agglomerated abrasive grain granules for the blend of abrasive grains in the present invention are three-dimensional granules that include a plurality of abrasive grains and a binding material. The agglomerated abrasive grain granules have an average dimension that is about 2 to 20 times larger than the average grit size of the abrasive grains. Preferably, the agglomerated abrasive grain granules have an average diameter in a range of between about 200 and about 3000 micrometers. Typically, the agglomerated abrasive grain granules have a loose packing density (LPD) of, e.g., about 1.6 g/cc for 120 grit size (106 microns) grain and about 1.2 g/cc for 60 grit (250 microns) size grain, and a porosity of about 30 to 88%, by volume. Agglomerated filamentary abrasive grain granules made with TG2 grain have a loose packing density of about 1.0 g/cc. For most grains, the loose packing density of the agglomerated abrasive grain is approximately 0.4 times the loose packing density of the same grain measured as loose, unagglomerated grain. The agglomerated abrasive grain granules preferably have a minimum crush strength value of about 0.2 MPa.

The agglomerated abrasive grain granules may include one or more of the abrasive grains known to be suitable for use in abrasive tools, such as the alumina grains, including fused alumina, non-filamentary sol-gel sintered alumina, sintered bauxite, and the like; silicon carbide; alumina-zirconia, including cofused alumina-zirconina and sintered alumina-zirconina; aluminum oxynitride; boron suboxide; garnet; flint; diamond, including natural and synthetic diamond; cubic boron nitride (CBN); and combinations thereof. Additional examples of suitable abrasive grains include unseeded, sintered sol-gel alumina abrasive grains that include microcrystalline alpha-alumina and at least one oxide modifier, such as rare-earth metal oxides (e.g., $CeO_2$, $Dy_2O_3$, $Er_2O_3$, $Eu_2O_3$, $La_2O_3$, $Nd_2O_3$, $Pr_2O_3$, $Sm_2O_3$, $Yb_2O_3$ and $Gd_2O_3$), alkali metal oxides (e.g., $Li_2O$, $Na_2O$ and $K_2O$ ), alkaline-earth metal oxides (e.g., MgO, CaO, SrO and BaO) and transition metal oxides (e.g., $HfO_2$, $Fe_2O_3$, MnO, NiO, $TiO_2$, $Y_2O_3$, ZnO and $ZrO_2$) (see, for example, U.S. Pat. Nos. 5,779,743, 4,314,827, 4,770,671, 4,881,951, 5,429,647 and 5,551,963, the entire teachings of which are incorporated herein by reference). Specific examples of the unseeded, sintered sol-gel alumina abrasive grains include rare-earth aluminates represented by the formula of $LnMAl_{11}O_{19}$, wherein Ln is a trivalent metal ion such as La, Nd, Ce, Pr, Sm, Gd, or Eu, and M is a divalent metal cation such as Mg, Mn, Ni, Zn, Fe, or Co (see, for example, U.S. Pat. No. 5,779,743). Such rare-earth aluminates generally have a hexagonal crystal structure, sometimes referred to as a magnetoplumbite crystal structure. A variety of examples of agglomerated abrasive grain granules can be found in U.S. Pat. No. 6,679,758 B2 and U.S. Pat. No. 6,988,937, the entire teachings of which are incorporated herein by reference.

Any size or shape of abrasive grain may be used. Preferably, the size of the agglomerated abrasive grain granules for the blend of abrasive grains is chosen to minimize the loss in wheel porosity and permeability. Grain sizes suitable for use in the agglomerated abrasive grain granules range from regular abrasive grits (e.g., greater than about 60 and up to about 7,000 microns) to microabrasive grits (e.g., about 0.5 to about 60 microns), and mixtures of these sizes. For a given abrasive grinding operation, it may be desirable to agglomerate abrasive grains with a grit size smaller than an abrasive grain (non-agglomerated) grit size normally selected for this abrasive grinding operation. For example, agglomerated 80 grit size (180 microns) abrasive may be substituted for 54 grit (300 microns) abrasive, agglomerated 100 grit (125 microns) for 60 grit (250 microns) abrasive and agglomerated 120 grit (106 microns) for 80 grit (180 microns) abrasive.

A preferred agglomerate size for typical abrasive grains ranges from about 200 to about 3,000, more preferably about 350 to about 2,000, most preferably about 425 to about 1,000 micrometers in average diameter. For microabrasive grain, a preferred agglomerate size ranges from about 5 to about 180, more preferably about 20 to about 150, most preferably about 70 to about 120 micrometers in average diameter.

In the agglomerated abrasive grain granules for the invention, abrasive grains are typically present at about 10 to about 95 volume % of the agglomerate. Preferably, abrasive grains are present at about 35 to about 95 volume %, more preferably about 48 to about 85 volume %, of the agglomerate. The balance of the agglomerate comprises binder material and pores.

As with the agglomerated abrasive grain granules, an agglomerate of the filamentary sol-gel abrasive grains for the use in the present invention are three-dimensional granules that include a plurality of filamentary sol-gel abrasive grains and a second binding material. Preferably, the agglomerate of the filamentary sol-gel abrasive grains further includes a secondary abrasive grain as described above. In one specific example, the secondary abrasive grain is non-filamentary in shape. In one embodiment, the agglomerate of the filamentary sol-gel abrasive grain that includes a plurality of grains of the filamentary sol-gel abrasive grain and secondary abrasive grain can be used for the blend of abrasive grains in combination with the agglomerated abrasive grain granules. In another embodiment, the agglomerate of the filamentary sol-gel abrasive grain that includes a plurality of grains of the filamentary sol-gel abrasive grain and secondary abrasive grain can be used for an abrasive for the abrasive tools of the invention without blending with the agglomerated abrasive grain granules. Typical features of the agglomerates of filamentary sol-gel abrasive grains are as discussed above for the agglomerated abrasive grain granules.

By selecting different grit sizes for blends of the filamentary grain and the non-filamentary grain, one may adjust the grinding performance of abrasive tools containing the agglomerated grains. For example, a tool used in a grinding operation operated at a relatively high material removal rate (MRR) can be made with a grain agglomerate comprising a 46 grit (355 microns) square or blocky alumina grain and an 80 grit (180 microns) TG2 grain. In a similar fashion, tools tailored for high MRR operations may contain agglomerates of just the 46 grit square or blocky alumina grain blended with loose, non-agglomerated grains of 80 grit TG2 grain. In another example, a tool used in a grinding operation requiring a controlled, fine surface finish, without scratches on the workpiece surface, can be made with a grain agglomerate comprising a 120 grit (106 microns) square or blocky alumina grain and an 80 grit (180 microns) TG2 grain. In an alternative embodiment, tools tailored for fine surface quality grinding or polishing operations may contain agglomerates of just the 120 grit (106 microns) square or blocky alumina grain blended with loose, non-agglomerated grains of 80 grit (180 microns) TG2 grain.

Any bond (binding) material typically used for bonded abrasive tools in the art can be used for the binding material of the agglomerated abrasive grain granules (hereinafter "the first binding material") and the second binding material of the agglomerate of filamentary sol-gel abrasive grains. Preferably, the first and second binding materials each independently include an inorganic material, such as ceramic materials, vitrified materials, vitrified bond compositions and combinations thereof, more preferably ceramic and vitrified materials of the sort used as bond systems for vitrified bonded abrasive tools. These vitrified bond materials may be a prefired glass ground into a powder (a fit), or a mixture of various raw materials such as clay, feldspar, lime, borax and soda, or a combination of fitted and raw materials. Such materials fuse and form a liquid glass phase at temperatures ranging from about 500 to about 1400° C. and wet the surface of the abrasive grain to create bond posts upon cooling, thus holding the abrasive grain within a composite structure. Examples of suitable binding materials for use in the agglomerates can be found, for example, in U.S. Pat. No. 6,679,758 B2 and U.S. Pat. No. 6,988,937. Preferred binding materials are characterized by a viscosity of about 345 to 55,300 poise at about 1180° C., and by a melting temperature of about 800 to about 1300° C.

In a preferred embodiment, the first and second binding materials are each independently a vitrified bond composition comprising a fired oxide composition of $SiO_2$, $B_2O_3$, $Al_2O_3$, alkaline earth oxides and alkali oxides. One example of the fired oxide composition includes 71 wt % $SiO_2$ and $B_2O_3$, 14 wt % $Al_2O_3$, less than 0.5 wt % alkaline earth oxides and 13 wt % alkali oxides.

The first and second binding materials also can be a ceramic material, including silica, alkali, alkaline-earth, mixed alkali and alkaline-earth silicates, aluminum silicates, zirconium silicates, hydrated silicates, aluminates, oxides, nitrides, oxynitrides, carbides, oxycarbides and combinations and derivatives thereof. In general, ceramic materials differ from glassy or vitrified materials in that the ceramic materials comprise crystalline structures. Some glassy phases may be present in combination with the crystalline structures, particularly in ceramic materials in an unrefined state. Ceramic materials in a raw state, such as clays, cements and minerals, can be used herein. Examples of specific ceramic materials suitable for use herein include silica, sodium silicates, mullite and other alumino silicates, zirconia-mullite, magnesium aluminate, magnesium silicate, zirconium silicates, feldspar and other alkali-alumino-silicates, spinels, calcium aluminate, magnesium aluminate and other alkali aluminates, zirconia, zirconia stabilized with yttria, magnesia, calcia, cerium oxide, titania, or other rare earth additives, talc, iron oxide, aluminum oxide, bohemite, boron oxide, cerium oxide, alumina-oxynitride, boron nitride, silicon nitride, graphite and combinations of these ceramic materials.

In general, the first and second binding materials are each independently used in powdered form and optionally, are added to a liquid vehicle to insure a uniform, homogeneous mixture of binding material with abrasive grain during manufacture of the agglomerates.

A dispersion of organic binders is preferably added to the powdered binding material components as molding or processing aids. These binders may include dextrins, starch, animal protein glue, and other types of glue; a liquid component, such as water, solvent, viscosity or pH modifiers; and mixing aids. Use of organic binders improves agglomerate uniformity, particularly the uniformity of the binding material dispersion on the grain, and the structural quality of the prefired or green agglomerates, as well as that of the fired abrasive tool containing the agglomerates. Because the organic binders are burnt off during firing of the agglomerates, they do not become part of the finished agglomerate nor of the finished abrasive tool. An inorganic adhesion promoter may be added to the mixture to improve adhesion of the binding materials to the abrasive grain as needed to improve the mix quality. The inorganic adhesion promoter may be used with or without an organic binder in preparing the agglomerates.

Although high temperature fusing binding materials are preferred in the agglomerates of the invention, the binding material also may comprise other inorganic binders, organic binders, organic bond materials, metal bond materials and combinations thereof. Binding materials used in the abrasive tool industry as bonds for organic bonded abrasives, coated abrasives, metal bonded abrasives and the like are preferred.

The binding material is present at about 0.5 to about 15 volume %, more preferably about 1 to about 10 volume %, and most preferably about 2 to about 8 volume % of the agglomerate.

The preferred volume % porosity within the agglomerate is as high as technically possible within the agglomerate mechanical strength limitations needed to manufacture an abrasive tool and to grind with it. Porosity may range from about 30 to about 88 volume %, preferably about 40 to about 80 volume % and most preferably, about 50 to about 75 volume %. A portion (e.g., up to about 75 volume %) of the porosity within the agglomerates is preferably present as interconnected porosity, or porosity permeable to the flow of fluids, including liquids (e.g., grinding coolant and swarf) and air.

The density of the agglomerates can be expressed in a number of ways. The bulk density of the agglomerates can be expressed as the LPD. The relative density of the agglomerates can be expressed as a percentage of initial relative density, or as a ratio of the relative density of the agglomerates to the components used to make the agglomerates, taking into account the volume of interconnected porosity in the agglomerates.

The initial average relative density, expressed as a percentage, can be calculated by dividing the LPD by a theoretical density of the agglomerates assuming zero porosity. The theoretical density can be calculated according to the volumetric rule of mixtures method from the weight percentage and specific gravity of the binding material and of the abrasive grain contained in the agglomerates. For the agglomerates useful in the invention, a maximum percent relative density is about 50 volume %, with a maximum percent relative density of about 30 volume % being more preferred.

The relative density can be measured by a fluid displacement volume technique so as to include interconnected porosity and exclude closed cell porosity. The relative density is the ratio of the volume of the agglomerates measured by fluid displacement to the volume of the materials used to make the agglomerates. The volume of the materials used to make the agglomerates is a measure of the apparent volume based on the quantities and packing densities of the abrasive grain and binder material used to make the agglomerates. In a preferred embodiment, a maximum relative density of the agglomerates preferably is about 0.7, with a maximum relative density of about 0.5 being more preferred.

The agglomerates of abrasive grains can be formed by a variety of techniques into numerous sizes and shapes. These techniques can be carried out before, during or after firing the initial ("green") stage mixture of grain and binding material. The step of heating the mixture to cause the binding material to melt and flow, thus adhering the binding material to the grain and fixing the grain in an agglomerated form, is referred to as firing, calcining or sintering. Any method known in the art for agglomerating mixtures of particles can be used to prepare the abrasive agglomerates. For example, methods disclosed in the previously incorporated U.S. Pat. No. 6,679,758 B2 and U.S. Pat. No. 6,988,937 can be used.

In a preferred embodiment, the agglomerates of abrasive grains, such as sintered agglomerated abrasive grain granules, are prepared by the steps of: i) feeding the abrasive grains and binding material into a rotary calcination kiln at a controlled feed rate; ii) rotating the kiln at a controlled speed; iii) heating the mixture at a heating rate determined by the feed rate and the speed of the kiln to a temperature in a range between about 80° C. and about 1,300° C.; iv) tumbling the grain and the binding material in the kiln until the binding material adheres to the grains and a plurality of grains adhere together to create the sintered agglomerated granules; and v) recovering the sintered agglomerated granules from the kiln. Preferably, the sintered agglomerated granules have a loose packing density equal to or less than about 1.6 g/cc.

In one example of the process used herein to make agglomerates, the initial mixture of grain and binding material is agglomerated before firing the mixture so as to create a relatively weak mechanical structure referred to as a "green agglomerate" or "pre-fired agglomerate." In this example, the abrasive grain and binding materials can be agglomerated in the green state by a number of different techniques, e.g., in a pan pelletizer, and then fed into a rotary calcination apparatus for sintering. The green agglomerates can be placed onto a tray or rack and oven fired, without tumbling, in a continuous or batch process.

The abrasive grain can be conveyed into a fluidized bed, then wetted with a liquid containing the binding material to adhere the binding material to the grain, screened for agglomerate size, and then fired in an oven or calcination apparatus.

Pan pelletizing can be carried out by adding grain to a mixer bowl, and metering a liquid component containing the binding material (e.g., water, or organic binder and water) onto the grain, with mixing, to agglomerate them together. A liquid dispersion of the binding material, optionally with an organic binder, can be sprayed onto the grain, and then the coated grain can be mixed to form agglomerates.

A low-pressure extrusion apparatus can be used to extrude a paste of grain and binding material into sizes and shapes which are dried to form agglomerates. A paste can be made of the binding materials and grain with an organic binder solution, and extruded into a desired shape, e.g., filamentary particles, with the apparatus and method disclosed in U.S. Pat. No. 4,393,021, the entire teachings of which are incorporated herein by reference.

In a dry granulation process, a sheet or block made of abrasive grain imbedded in dispersion or paste of the binding material may be dried and then a roll compactor can be used to break the composite of grain and binding material.

In another method of making green or precursor agglomerates, the mixture of the binding material and the grain can be added to a molding device and the mixture molded to form precise shapes and sizes, for example, in the manner disclosed in U.S. Pat. No. 6,217,413 B1, the entire teachings of which are incorporated herein by reference.

In a second example of the process useful herein for making agglomerates, a simple mixture, preferably a substantially homogeneous mixture, of the grain and binding material (optionally with an organic binder) is fed into a rotary calcination apparatus (see, for example, U.S. Pat. No. 6,679,758). The mixture is tumbled at a predetermined rpm and along a predetermined incline, with the application of heat. Agglomerates are formed as the binding material mixture heats, melts, flows and adheres to the grain. The firing and agglomeration steps are carried out simultaneously at controlled rates and volumes of feeding and heat application. The feed rate generally is set to yield a flow occupying roughly 8-12%, by volume, of the tube (i.e., the kiln portion) of the rotary calcination apparatus. The maximum temperature exposure within the apparatus is selected to keep the viscosity of the binding materials in a liquid state at a viscosity of at least about 1,000 poise. This avoids excessive flow of the binding material onto the surface of the tube and loss of binding material from the surface of the abrasive grain. The agglomeration process for agglomerating and firing the agglomerates can be carried out in a single process step or in two separate steps, preferably, in a single process step.

Suitable rotary calcination machines may be obtained from Harper International, Buffalo, N.Y., or from Alstom Power, Inc., Applied Test Systems, Inc., and other equipment manufacturers. The apparatus optionally may be fitted with electronic, in-process control and detection devices, a cooling system, various designs of feed apparatus and other optional devices.

When agglomerating abrasive grain with lower temperature curing (e.g., about from about 80 to about 500° C.) binding materials, a rotary kiln apparatus equipped with a rotary dryer can be used. The rotary dryer supplies heated air to the discharge end of the tube to heat the abrasive grain mixture, thereby curing the binding material and bonding it to the grain, and to thereby agglomerate the abrasive grain as it is collected from the apparatus. As used herein, the term "rotary calcination kiln" is exemplified by such rotary dryer devices.

In a third example of the process useful herein for making agglomerates, a mixture of the abrasive grain, binding materials and an organic binder system is fed into an oven, without pre-agglomeration, and heated. The mixture is heated to a temperature high enough to cause the binding material to melt, flow and adhere to the grain, then cooled to make a composite. The composite is crushed and screened to make the sintered agglomerates.

In a fourth example, the agglomerates are not sintered before making the abrasive tool, rather the "green" agglomerates are molded with bond material to form a tool body and the body is fired to form the abrasive tool. In a preferred method of carrying out this process, a high viscosity (when melted to form a liquid) vitrified binding material is used to agglomerate grain in the green state. The green agglomerates are oven-dried and mixed with a second, preferably lower viscosity, vitrified bond composition and molded into the form of a green abrasive tool. This green tool is fired at a temperature that is effective to fuse, but to avoid flow of, the high viscosity vitrified binding material. The firing temperature is selected to be sufficiently high to fuse the binding material composition into a glass; thereby agglomerating the grain, and to cause the bond composition to flow, bond the agglomerates and form the tool. It is not essential to select different viscosity materials materials with different fusing or melting temperatures to carry out this process. Other combinations of binding materials and bond materials known in the art may be used in this technique for making abrasive tools from green-state agglomerates.

The bonded abrasive tools of the invention include generally any type of conventional abrasive product. Examples of such conventional abrasive products include grinding wheels, cutoff wheels and honing stones, which are comprised of a bond component and a blend of abrasive grains, or an agglomerate of filamentary sol-gel abrasive grains, as described above. Suitable methods for making bonded abrasive tools are disclosed in U.S. Pat. Nos. 5,129,919, 5,738,696 and 5,738,697, the entire teachings of which are incorporated herein by reference.

Any bond normally used in abrasive articles can be employed in the present invention. The amounts of bond and abrasive vary typically from about 3% to about 25% bond and about 10% to about 70% abrasive grain, by volume, of the tool. Preferably, the blend of abrasive grains are present in the bonded abrasive tool in an amount of about 10-60%, more preferably about 20-52%, by volume of the tool. Also, when the agglomerate of filamentary sol-gel abrasive grains is used without blending with the agglomerated abrasive granules, the amount of the agglomerate of filamentary sol-gel abrasive grains are present in the bonded abrasive tool in an amount of about 10-60%, more preferably about 20-52%, by volume of the tool. A preferred amount of bond can vary depending upon the type of bond used for the abrasive tool.

In one embodiment, the abrasive tools of the invention can be bonded with a resin bond. Suitable resin bonds include phenolic resins, urea-formaldehyde resins, melamine-formaldehyde resins, urethane resins, acrylate resins, polyester resins, aminoplast resins, epoxy resins, and combinations thereof. Examples of suitable resin bonds and techniques for manufacturing such bonds can be found, for example, in U.S. Pat. Nos. 6,251,149; 6,015,338; 5,976,204; 5,827,337; and 3,323,885, the entire teachings of which are incorporated herein by reference. Typically, the resin bonds are contained in the compositions of the abrasive tools in an amount of about 3%-48% by volume. Optionally, additives, such as fibers, grinding aids, lubricants, wetting agents, surfactants, pigments, dyes, antistatic agents (e.g., carbon black, vanadium oxide, graphite, etc.), coupling agents (e.g., silanes, titanates, zircoaluminates, etc.), plasticizers, suspending agents and the like, can be further added into the resin bonds. A typical amount of the additives is about 0-70% by volume of the tool.

In another embodiment, the bond component of the tool comprises an inorganic material selected from the group consisting of ceramic materials, vitrified materials, vitrified bond compositions and combinations thereof. Examples of suitable bonds may be found in U.S. Pat. Nos. 4,543,107; 4,898,597; 5,203,886; 5,025,723; 5,401,284; 5,095,665; 5,711,774; 5,863,308; and 5,094,672, the entire teachings of all of which are incorporated herein by reference. For example, suitable vitreous bonds for the invention include conventional vitreous bonds used for fused alumina or sol-gel alumina abrasive grains. Such bonds are described in U.S. Pat. Nos. 5,203,886, 5,401,284 and 5,536,283. These vitreous bonds can be fired at relatively low temperatures, e.g., about 850-1200° C. Other vitreous bonds suitable for use in the invention may be fired at temperatures below about 875° C. Examples of these bonds are disclosed in U.S. Pat. No. 5,863,308. Preferably, vitreous bonds which can be fired at a temperature in a range of between about 850° C. and about 1200° C. are employed in the invention. In one specific example, the vitreous bond is an alkali boro alumina silicate (see, for example, U.S. Pat. Nos. 5,203,886, 5,025,723 and 5,711,774).

The vitreous bonds are contained in the compositions of the abrasive tools typically in an amount of less than about 28% by volume, such as between about 3 and about 25 volume %; between about 4 and about 20 volume %; and between about 5 and about 18.5 volume %.

Optionally, the bond component of the abrasive tool and the binding materials, including the first and second binding materials, can include the same type of bond compositions, such as a vitrified bond composition comprising a fired oxide compositions of $SiO_2$, $B_2O_3$, $Al_2O_3$, alkaline earth oxides and alkali oxides.

The filamentary sol-gel abrasive grain in combination of the agglomerated abrasive grain, or the agglomerate of filamentary sol-gel abrasive grain with or without blending with the agglomerated abrasive grain granules, allows the production of bonded abrasive tools with a highly porous and permeable structure. However, optionally, conventional pore inducing media such as hollow glass beads, solid glass beads, hollow resin beads, solid resin beads, foamed glass particles, bubbled alumina, and the like, may be incorporated in the present wheels thereby providing even more latitude with respect to grade and structure number variations.

The bonded abrasive tools of the invention preferably contain from about 0.1% to about 80% porosity by volume. More preferably, they contain from about 35% to about 80%, and even more preferably they contain from about 40% to about 68 volume %, of the tool.

When a resin bond is employed, the combined blend of abrasive grains and resin bond component is cured at a temperature, for example, in a range of between about 60° C. and about 300° C. to make a resinoid abrasive tool. When a vitreous bond is employed, the combined blend of abrasive grains and vitreous bond component is fired at a temperature, for example, in a range of between about 600° C. and about 1350° C. to make a vitrified abrasive tool.

When a vitreous bond is employed, the vitrified abrasive tools typically are fired by methods known to those skilled in the art. The firing conditions are primarily determined by the actual bond and abrasives used. Firing can be performed in an inert atmosphere or in air. In some embodiments, the combined components are fired in an ambient air atmosphere. As used herein, the phrase "ambient air atmosphere," refers to air drawn from the environment without treatment.

Molding and pressing processes to form abrasive tools, such as wheels, stones, hones and the like, can be performed by methods known in the art. For example, in U.S. Pat. No. 6,609,963, the entire teachings of which are incorporated herein by reference, teaches one such suitable method.

Typically, the components are combined by mechanical blending. Additional ingredients, such as, for example, organic binder, can be included, as is known in the art. Components can be combined sequentially or in a single step. Optionally, the resulting mixture can be screened to remove agglomerates that may have formed during blending.

The mixture is placed in an appropriate mold for pressing. Shaped plungers are usually employed to cap off the mixture. In one example, the combined components are molded and pressed in a shape suitable for a grinding wheel rim. Pressing can be by any suitable means, such as by cold pressing or by hot pressing, as described in U.S. Pat. No. 6,609,963. Molding and pressing methods that avoid crushing the hollow bodies are preferred.

Cold pressing is preferred and generally includes application, at room temperature, of an initial pressure sufficient to hold the mold assembly together.

When hot pressing is employed, pressure is applied prior to, as well as during, firing. Alternatively, pressure can be applied to the mold assembly after an article is removed from a furnace, which is referred to as "hot coining."

In some embodiments where the hollow bodies are employed, preferably at least 90 percent by weight of the hollow bodies remain intact after molding and pressing.

The abrasive article is removed from the mold and air-cooled. In a later step, the fired tool can be edged and finished according to standard practice, and then speed-tested prior to use.

The abrasive tools of the invention are suitable for grinding all types of metals, such as various steels including stainless steel, cast steel and hardened tool steel; cast irons, for example ductile iron, malleable iron, spheroidal graphite iron, chilled iron and modular iron; and metals like chromium, titanium and aluminum. In particular, the abrasive tools of the invention are efficient in grinding applications where there is a large contact area with the workpiece, such as creepfeed, gear and surface grinding and especially where difficult-to-grind and heat sensitive materials such as nickel based alloys are used.

The invention is further described by the following examples which are not intended to be limiting.

EXEMPLIFICATION

Example 1

Preparation of Abrasive Wheels with a Blend of Two Agglomerate Feedstocks

Various combinations of an agglomerate of filamentary sol-gel abrasive grain and agglomerated abrasive grain granules were prepared for experimental abrasive grinding wheels, as described in Table 1. Herein, "TG2 " represents an example of a filamentary, seeded sol-gel alumina abrasive grain obtained from Saint-Gobain Abrasives in Worcester, Mass. Norton®38A fused alumina abrasive grain which are available from the same company were used for the agglomerated abrasive grain granules (hereinafter "38A").

A set of experimental wheels was formulated with different ratios of TG2 grain to agglomerate of 38A grain. Such wheels having a blend of a filamentary sol-gel alumina abrasive grain, or an agglomerate thereof, and agglomerated abrasive grain granules are hereinafter referred to "agglomerated grain-TG2" type wheels. Four agglomerated grain-TG2 wheels (20)-(23) were made with overall amounts of 10, 30, 50 and 75 wt % of TG2 and respectively 90, 70, 50 and 25 wt % of 38A grains. The wheels were made from two agglomerate feedstocks:

a) agglomerate of 75 wt % of TG2 (8:1 aspect ratio) and 25 wt % of 38A having 120 mesh size (38A-120)) in 3 wt % of Binding Material C described in Table 2 of U.S. Pat. No. 6,679,758 B2 (fired composition comprises 71 wt % glass formers ($SiO_2$+$B_2O_3$); 14 wt % $Al_2O_3$; <0.5 wt % alkaline earth RO (CaO, MgO); 13 wt % alkali $R_2O$ ($Na_2O$, $K_2O$, $Li_2O$), spec. gravity is 2.42 g/cc and viscosity (Poise) at 1180° C. is 345); and b) agglomerate of 38A having 60 mesh size (38A-60) in 3 wt % of Binding Material C.

Feedstock a) contains an agglomerate of 75 wt % of TG2 grains having 80 mesh size and 25 wt % of fused alumina 38A grains having 120 mesh size (38A-120). Feed stock b) contains an agglomerate of fused alumina 38A grains having 60 mesh sizes (38A-60). For each feedstock, 3 wt % of Binding Material C was used as the binding material. Agglomerates a) and b) were prepared in a rotary kiln by the method described in Example 5 of U.S. Pat. No. 6,679,758 B2, except that the kiln was operated at 1150° C. The FIGURE shows a scanning electron microscopy (SEM) picture of the agglomerate a) of a blend of 75 wt % of TG2 and 25 wt % of 38A-120, agglomerated with 3 wt % of Binding Material C. As shown in the FIGURE, fine grits of 38A-120 resulted in good grain coverage of the filamentary TG2 grain.

Four different blends of abrasive grains of the invention were consequently obtained by changing the blend ratio of agglomerates a) and b), as summarized in Table 1.

TABLE 1

Blends of Abrasive Grains for Abrasive Tools (20)-(23)

| Sample # | TG2/ (TG2 + 38A), wt % | (75 wt % TG2 + 25 wt % 38A-120) + 3 wt % Binding Material C | 38A-60 + 3 wt % Binding Material C |
|---|---|---|---|
| (23) | 10 | 13 | 87 |
| (22) | 30 | 40 | 60 |
| (21) | 50 | 67 | 33 |
| (20) | 75 | 100 | 0 |

Grinding wheels having a finished size 20"×1"×8" (50.8 cm×2.5 cm×20.3 cm) were then constructed by mixing the abrasive grain and agglomerates with Binding Material C, molding the mix into a wheel and firing the molded wheels at 950° C. The agglomerate cut −12/+pan (US Standard Sieve-mesh size; retained agglomerates smaller than 12 mesh) was used.

As a control, a wheel employing 100% of a conventional agglomerate of 38A-120 (sample (24)) as an abrasive was prepared by the method described in Example 7 of U.S. Pat. No. 6,679,758 B2.

Other standard wheels (27) and (28) employed abrasives that include 100% of non-agglomerate of 38A-120 and 100% of non-agglomerate of 38A-60, respectively, and standard wheels (25) and (26) employed abrasives that include 100% of non-agglomerate of TG2 -80 and non-agglomerate of TG2 -120, respectively. These standard wheels were commercial products obtained from Saint-Gobain Abrasives, Inc., Worcester, Mass., and marked with the commercial wheel designations indicated for each in Table 2. Hereinafter, the wheels employing conventional agglomerates, such as an agglomerate of 38A, are referred to "agglomerated grain control wheels." Similarly, the wheels employing conventional filamentary sol-gel abrasive grains, such as TG2 grains, are hereinafter referred to "TG2 wheels."

Example 2

Mechanical Properties of Abrasive Wheels of Example 1

A. Elastic Modulus (Emod)

All data concerning Emod were measured by a Grindosonic machine, by the method described in J. Peters, "Sonic Testing of Grinding Wheels," *Advances in Machine Tool Design and Research*, Pergamon Press, 1968.

Physical properties of agglomerated grain-TG2 wheels (20)-(23) are presented in Table 2 below and compared against standard agglomerated grain wheels (24); standard TG2 wheels (25) and (26); and conventional standard wheels (27) and (28). As shown in Table 2, the elastic moduli of standard TG2 wheels (25) and (26) were similar to that of standard 38A-60 wheel (28). The elastic modulus of standard TG2 wheels (26) was the highest value among those of the tested wheels. Agglomerated grain wheel (24) quite unexpectedly featured up to about 40% elastic modulus reduction as compared with TG2 wheels (25) and (26). Interestingly, the elastic moduli of agglomerated grain-TG2 wheels (20)-(23) ranged from 37 to 42% lower than those of TG2 wheels (25) and (26). It is noticeable that the elastic moduli of agglomerated grain-TG2 wheels (20-23) did not significantly change with the TG2/38A ratio, remaining close to the elastic modulus of agglomerated grain wheel (24).

TABLE 2

Characteristics of Abrasive Wheels of Example 1

| Wheels (wt % of abrasive blend in wheels) | Wheel Composition Volume % | | | | Fired Density | Mod. of Elasticity | Mod. of Rupture | Hardness (sand blasting)[c] |
|---|---|---|---|---|---|---|---|---|
| | Aggl. | Abra. | Bond[b] | Porosity | g/cc | (GPa) | (MPa) | |
| Comparative wheel (25) TG2-80 E13 VCF3[a] | N/A | 38 | 6.4 | 55.6 | 1.67 | 23.5 | 23 | 1.61 |
| Comparative wheel (26) TG2 120-E13 VCF3[a] | N/A | 36.2 | 8.2 | 55.6 | 1.66 | 24.2 | 21.0 | 1.46 |
| (20) 75% TG2 | 38 | 36.2 | 8.2 | 55.6 | 1.63 | 14.5 | 14.6 | 2.81 |
| (21) 50% TG2 | 38 | 36.2 | 8.2 | 55.6 | 1.64 | 13.8 | 16.5 | 2.32 |
| (22) 30% TG2 | 38 | 36.2 | 8.2 | 55.6 | 1.64 | 14.3 | 17.9 | 2.32 |
| (23) 10% TG2 | 38 | 36.2 | 8.2 | 55.6 | 1.64 | 15.2 | 21.2 | 2.81 |
| Comparative wheel (27) 38A120-E13 VCF2[a] | N/A | 36.2 | 8.2 | 55.6 | 1.67 | 15.9 | 28 | 2.90 |
| Comparative wheel (24) 100% 38A120 | 38 | 36.2 | 8.2 | 55.6 | 1.64 | 14.9 | 24.6 | 2.84 |
| Comparative wheel (28) 38A60-K75 LCNN[a] | N/A | 38.4 | 7.7 | 53.9 | 1.75 | 23.5 | N/A | 1.35 |

[a]Comparative wheels are commercial products obtained from Saint-Gobain Abrasives, Inc. (Norton Company), and marked with the alphanumeric wheel designations indicated for each.
[b]Values for volume % bond of the wheels employing agglomerates include the volume % glass binding material used on the grains to make the agglomerates plus the wheel bond.
[c]Sandblast values demonstrate that the experimental wheels were softer than the non-agglomerated grain comparative wheels 25, 26 and 28.

B. Modulus of Rupture (MOR)

Modulus of rupture was determined on bars for the samples (20)-(27) of Example 1 by using an Instron® Model MTS 1125 mechanical testing machine with a 4-point bending jig with a support span of 3", a load span of 1", and at a loading rate of 0.050" per minute crosshead speed. The measurements were done by applying force to the sample until it ruptures and recording force at the point of rupture. The results are summarized in Table 2 above. As can be seen in Table 2, agglomerated grain wheel (24) generally featured a rupture modulus quite similar to standard products (25), (26) and (27). In general, lower moduli of rupture than that of these products were observed on agglomerated grain-TG2 products (20)-(23) (see Table 2). While the MOR data of agglomerated grain-TG2 wheels (20)-(22), except agglomerated grain-TG2 wheel (23), were relatively lower than those of standard wheels (25), (26) and (27), they were relatively higher in comparison to the MOR of 13-16 MPa that was measured on conventional agglomerated grain wheels employing 38A-60 agglomerates (see Table 6-2 of WO 03/086,703). Thus, the MOR data of agglomerated grain-TG2 wheels (20)-(23) are still sufficient to provide enough mechanical strength for grinding operation, as illustrated in Example 3 below.

The drop of modulus of rupture observed on agglomerated grain-TG2 wheels (20)-(23) may be due to the fact that these agglomerated grain-TG2 wheels were softer than expected given their composition. The drop in fired density shown in Table 2 is believed due to the absence of shrinkage. This drop in density also indicates that the agglomerated grain-TG2 wheels resisted shrinkage during thermal processing relative to the comparative wheels having an identical volume % composition but made without agglomerated grain (i.e., volume % grain, bond and pores, to the total of 100%). This feature of the agglomerated grain-TG2 wheels indicates significant potential benefits in abrasive wheel manufacturing and finishing operations.

The relatively low stiffness (e-modulus) of the agglomerated grain-TG2 wheels of the invention that has been achieved without sacrificing mechanical strength (modulus of rupture) was quite unique and unexpected.

C. Speed Test/Burst Speed

Mechanical strength properties generally determine whether a composite can be used as a bonded abrasive tool in a grinding operation. For vitrified wheels, a relationship is employed to link the mechanical strength (modulus of rupture) of a composite test bar to the rotational tensile stress that generates failure of that same composite. As a consequence, the modulus of rupture measured on a test bar can provide a quick and accurate estimation of the burst speed of a grinding wheel made by the same process using the same formulation as the test bar.

Burst speed testing of grinding wheels can be directly measured in the standardized test described in ANSI Standard B7.1-1988 (1995).

Conventional creepfeed grinding operations traditionally operate grinding wheels at 6500 sfpm (33 m/s) with a maximum operating speed of about 8500 sfpm (43.2 m/s). The burst speed test values of all agglomerated grain-TG2 wheels (20)-(23) were fully acceptable for use in creepfeed grinding operations.

Example 3

Grinding Performance of the Abrasive Wheels of Example 1

Agglomerated grain-TG2 wheels (20-23) of Example 1 were tested in creepfeed grinding operations against the comparative commercial wheels, (25),(26) and (27), recommended for use in creepfeed grinding operations. Agglomerated grain wheel (24) (laboratory sample) and a commercial agglomerated grain wheel (29) obtained from Saint-Gobain Abrasives, Inc., Worcester, Mass., were also tested as control wheels.

Creepfeed grinding is a low force grinding (large surface of contact) application commonly used for high material removal and burn sensitive materials. Three major product characteristics make a creepfeed wheel grinding better: i) low grinding power; ii) low burn sensitivity; and iii) low dress compensation. Reducing grinding power can allow grinding at a higher removal rate. Reducing burn sensitivity can also allow grinding at a higher removal rate. Reducing dress compensation while maintaining high removal rate and burn-free can allow increasing the wheel life.

All of the wheels used for the creepfeed grinding tests had the same size dimensions of 20×1×8", and were tested using the Hauni-Blohm Profimat 410. A wedge grinding test was performed, where the workpiece was inclined at a small angle (0.05°) relative to the machine slide upon which it was mounted. This geometry resulted in increasing depth of cut, increasing a material removal rate and increasing chip thickness as the grind progressed from start to finish. In these grinding runs, the continuous increase of depth of cut provided a continuous increase in material removal rate (MRR) over the block length (8 inches (20.3 cm)). Thus, grinding data was gathered over a range of conditions in a single run. The evaluation of wheel performance in the wedge test was further aided through electronic measurement and recordal of spindle power and grinding forces. The precise determination of conditions (metal removal rate (MRR), chip thickness, etc.) that produced unacceptable results, such as grinding burn or wheel breakdown, facilitated the characterization of wheel behaviors and the ranking of relative product performance.

Standard Grinding Conditions for Wedge Creepfeed Grinding Tests:

| | |
|---|---|
| i) | Machine: Hauni-Blohm Profimat 410 |
| ii) | Mode: Wedge creepfeed grind |
| iii) | Wheel speed: 5500 surface feet per minute (28 m/sec) |
| iv) | Table speed: Varied from 5 to 17.5 inches/minute (12.7-44.4 cm/minute) |
| v) | Coolant: Master Chemical Trim E210 200, at 10% concentration with deionized well water, 72 gal/min (272 L/min) |
| vi) | Workpiece material: Inconel 718 (42 HRc) |
| vii) | Dress mode: rotary diamond, continuous |
| viii) | Dress compensation: 10, 20 or 60 micro-inch/revolution (0.25, 0.5 or 1.5 micrometer/rev) |
| ix) | Speed ratio: +0.8. |

Standard Grinding Conditions for Slot Creepfeed Grinding Tests

| | |
|---|---|
| i) | Machine: Hauni-Blohm Profimat 410 |
| ii) | Mode: Slot creepfeed grind |
| iii) | Wheel speed: 5500 surface feet per minute (28 m/sec) |
| iv) | Table speed: Varied from 5 to 17.5 inches/minute (12.7-44.4 cm/minute) |
| v) | Coolant: Master Chemical Trim E210 200, at 10% concentration with deionized well water, 72 gal/min (272 L/min) |
| vi) | Workpiece material: Inconel 718 (42 HRc) |
| vii) | Dress mode: rotary diamond, continuous |
| viii) | Dress compensation: 15 micro-inch/revolution |
| ix) | Speed ratio: +0.8. |

A failure was denoted by workpiece burn, rough surface finish or by loss of corner form. Wheel wear was not recorded since it was a continuous dress grinding test. The material removal rate at which a failure occurred (maximum MRR) was noted.

A. Wedge Grinding of Agglomerated Grain-Tg2 Wheels at 20 μin/rev of Dressing Rate Maximum grinding rates (MRR) and specific grinding energies of the tested wheels (20)-(27) at 20 μin/rev of dressing rate and 0.01 inch of initial depth of cut wedge are summarized in Table 3. Before a failure occurred, standard agglomerated grain wheel (24) exhibited 53% lower material removal rate than the value of TG2 wheel (25). agglomerated grain-TG2 wheels (22) and (23) employing 10 and 30 wt % TG2 exhibited similar MRR's to that of standard agglomerated grain wheel (24). Agglomerated grain-TG2 wheel (21) employing 50 wt % TG2 exhibited a very similar maximum removal rate to the values of TG2 wheels (25) and (26) (about 12% and about 6% lower than those of TG2 wheels (25) and (26), respectively). Quite surprisingly, agglomerated grain-TG2 wheel (20) employing 75 wt % TG2 exhibited the highest MRR value among the tested wheels, which was 27% higher than the value of TG2 wheel (25). Thus, the MRR data of the agglomerated grain-TG2 wheels demonstrated significant benefits of the combination of agglomerated grain and TG2 technologies.

These results suggest that certain combinations of agglomerated grain and TG2 technologies can allow grinding performance superior to that of TG2 technology. This unexpected superior performance of the agglomerated grain-TG2 wheels of the invention over the TG2 wheels make the present invention, i.e., the combination of agglomerated grain and TG2 technologies, a breakthrough technology.

TABLE 3

Grinding Test Results with 20 micro-inch/revolution (μin/rev) of Dressing Rate and 0.01 inch of Intial depth of cut Wedge

| | Wheel Composition Volume % | | | | Max, MRR[a] | Specific Grinding | MRR Improvement | Failure |
|---|---|---|---|---|---|---|---|---|
| | Agglo. | Abra. | Bond[b] | Porosity | $mm^3/s/mm$ | Energy (J/mm) | vs TG2 (%) | mode |
| Control wheel (25)* TG2-80 E13 VCF3 | N/A | 38 | 6.4 | 55.6 | 12.2 | 29.9 | N/A | Burn |
| Control wheel (26)* TG2-120 E13 VGF3 | N/A | 36.2 | 8.2 | 55.6 | 10.1 | 33.15 | N/A | Burn |
| (20) 75% TG2 | 38 | 36.2 | 8.2 | 55.6 | 15.45 | 26.1 | 27 | Burn |
| (21) 50% TG2 | 38 | 36.2 | 8.2 | 55.6 | 10.7 | 29.4 | −12 | Burn |
| (22) 30% TG2 | 38 | 36.2 | 8.2 | 55.6 | 6.5 | 38.1 | −47 | Burn |
| (23) 10% TG2 | 38 | 36.2 | 8.2 | 55.6 | 5.83 | — | −48 | Burn |
| Control wheel (27)* 38A120-E13 VCF2 | N/A | 36.2 | 8.2 | 55.6 | 5.8 | 48.1 | −53 | Burn |
| Control wheel (24)* 100% 38A120 | 38 | 36.2 | 8.2 | 55.6 | 5.8 | 46.95 | −53 | Burn |

*Comparative control wheels are commercial products obtained from Saint-Gobain Abrasives, Inc. (Norton Company).

[a]Dressing rate = 20 μin/rev; Wheel speed = 5500 sfpm; Initial d.o.c. wedge = 0.01 inch.

[b]Values for volume % bond of the wheels employing agglomerates include the volume % glass binding material used on the grains to make the agglomerates plus the wheel bond.

B. Comparison of Agglomerated Grain-Tg2 Wheels with Conventional Tg2-Wheels

The MRR data of agglomerated grain-TG2 wheels at a different initial depth of cut wedge than that of section A of Example 3 were compared to the MRR data of standard TG2 wheel (25) (see Table 4). The MRR data in Table 4 were obtained at 0.05 inch of initial depth of cut wedge. As shown in Table 4, even at this different condition, agglomerated grain-TG2 wheel (20) showed the highest maximum MRR value among the tested wheels, which was 43.8% improvement over that of TG2 wheel (25).

TABLE 4

Grinding Test Results with 20 micro-inch/revolution (μin/rev) of Dressing Rate and 0.05 inch of Intial Depth of cut Wedge

| | Wheel Composition Volume % | | | | Max, MRR[a] | Specific Grinding | MRR Improvement | Failure |
|---|---|---|---|---|---|---|---|---|
| Wheel | Agglo. | Abra. | Bond[b] | Porosity | $mm^3/s/mm$ | Energy (J/mm) | vs, TG2 (%) | mode |
| Control wheel (25)* TG2-80 E13 VCF3 | N/A | 38 | 6.4 | 55.6 | 12.8 | 56.3 | N/A | Burn |
| (20) 75% TG2 | 38 | 36.2 | 8.2 | 55.6 | 18.4 | 42.3 | +43.8 | Burn |
| (21) 50% TG2 | 38 | 36.2 | 8.2 | 55.6 | 10.6 | 52.2 | −18 | Burn |
| Control wheel (28)* 38A60-K75 LCNN | N/A | 38.4 | 7.7 | 53.9 | 8.1 | 55.1 | −37 | Burn |

TABLE 4-continued

| Grinding Test Results with 20 micro-inch/revolution (μin/rev) of Dressing Rate and 0.05 inch of Intial Depth of cut Wedge | | | | | | | | |
|---|---|---|---|---|---|---|---|---|
| | Wheel Composition Volume % | | | | Max, MRR[a] | Specific Grinding | MRR Improvement | Failure |
| Wheel | Agglo. | Abra. | Bond[b] | Porosity | $mm^3/s/mm$ | Energy (J/mm) | vs, TG2 (%) | mode |
| Control wheel (29)* 100% 38A-60 | 38 | 36.4 | 10.7 | 52.9 | 10.2 | 46.5 | −20 | Burn |

*Comparative control wheels are commercial products obtained from Saint-Gobain Abrasives, Inc. (Norton Company).
[a]Dressing rate = 20 μin/rev; Wheel speed = 5500 sfpm; Initial depth of cut wedge = 0.05 inch.
[b]Values for volume % bond of the wheels employing agglomerates include the volume % glass binding material used on the grains to make the agglomerates plus wheel bond.

C. Effect of Dressing Rate on Material Removal Rate

The effect of dressing rate on the material removal rate was also examined on the TG2, agglomerated grain-TG2 and standard 38A products. The grinding test data shown in Table 5 were performed at three dress compensation rates, 10, 20 and 60 micro-inch/revolution (μin/rev).

The maximum removal rate of the standard 38A wheel (27) featured a logarithmic variation as a function of dressing rate. In contrast, TG2 wheel (25) allowed a constant increase of material removal rate, allowing the wheel to be used for high productivity applications. The data in Table 5 show that agglomerated grain-TG2 wheels (20)-(23) exhibited MRR variation varied from that of standard 38A wheel (27) to that of TG2 wheel (25) according to the TG2 contents. In particular, agglomerated grain-TG2 wheels (20) and (21) featured a linear increase of MRR with respect to the dressing rate, which indicates that these wheels performed similarly to TG2 wheel (25). It is noted that agglomerated grain-TG2 wheel (20) exhibited 58% higher MRR values relative to that of TG2 wheel (25) at a very low dressing rate of 10 μin/rev. Also, it is noted that agglomerated grain-TG2 wheel (21) showed very similar MRR data as that to that of TG2 wheel (25) at various dressing rates, in particular at 10 μin/rev and 20 μin/rev. These results indicate that the grinding efficiency of the agglomerated grain-TG2 wheels of the invention can be higher in comparison to the conventional TG2 wheels when compensation rates are reduced, for example, between 5 and 10 μin/rev.

EQUIVALENTS

While this invention has been particularly shown and described with references to preferred embodiments thereof, it will be understood by those skilled in the art that various changes in form and details may be made therein without departing from the scope of the invention encompassed by the appended claims.

What is claimed is:

1. A bonded abrasive tool comprising:

a) a blend of abrasive grains including:

i) agglomerates including filamentary sol-gel alumina abrasive grain having a length-to-cross-sectional-width aspect ratio of at least about 2:1 and non-filamentary abrasive grains; and ii) agglomerated abrasive grain granules including a plurality of abrasive grains held in a three-dimensional shape by a binding material, the abrasive grains having a length-to-cross-sectional-width aspect ratio of about 1.0;

b) a bond; and c) about 35 volume percent to 80 volume percent porosity wherein a total amount of non-filamentary abrasive grains present in the blend is less than or equal to 50% of the weight of the blend.

2. The bonded abrasive tool of claim 1, wherein the bonded abrasive tool has a structure permeable to fluid flow.

TABLE 5

| Grinding Test Results-Dressing Rates | | | | | | | | | | |
|---|---|---|---|---|---|---|---|---|---|---|
| | Wheel Composition Volume % | | | | Max. MRR[a] 10 μin/rev | Improvement % | Max. MRR[a] 20 μin/rev | Improvement % | Max. MRR[a] 60 μin/rev | Improvement % |
| Wheel | Agg. | Abr. | Bond | | mm3/s/mm | vs TG2 | mm3/s/mm | vs TG2 | mm3/s/mm | vs TG2 |
| Control wheel (25)* TG2-80 E13 VCF3 | N/A | 38 | 6.4 | 55.6 | 6.2 | N/A | 12.2 | N/A | 15.4 | N/A |
| (20) 75% TG2 | 38 | 36.2 | 8.2 | 55.6 | 9.8 | 58 | 15.5 | 27 | 25.1 | ex. wear |
| (21) 50% TG2 | 38 | 36.2 | 8.2 | 55.6 | 5.8 | −6 | 10.7 | −12 | 31 | corner wear |
| (22) 30% TG2 | 38 | 36.2 | 8.2 | 55.6 | 4.5 | −27 | 6.5 | −47 | N/A | N/A |
| (23)10% TG2 | 38 | 36.2 | 8.2 | 55.6 | N/A | N/A | 5.8 | −52 | N/A | N/A |
| Control wheel (27)* 38A120-E13 VCF2 | N/A | 36.2 | 8.2 | 55.6 | 3.9 | −37 | 5.8 | −53 | 7.7 | −50 |

*Comparative control wheels are commercial products obtained from Saint-Gobain Abrasives, Inc. (Norton Company).
[a]Wheel speed = 5500 sfpm; Initial depth of cut wedge = 0.05 inch.
[b]Values for volume % bond of the wheels employing agglomerates include the volume % glass binding material used on the grains to make the agglomerates plus wheel bond.

3. The bonded abrasive tool of claim 1, wherein the filamentary sol-gel alumina abrasive grain has an aspect ratio of at least about 4:1 and comprises predominantly alpha alumina crystals having a size of less than about 2 microns.

4. The bonded abrasive tool of claim 1, comprising about 50-75 volume percent total porosity.

5. The bonded abrasive tool of claim 1, wherein at least about 30 volume percent of the total porosity is interconnected porosity.

6. The bonded abrasive tool of claim 1, wherein the abrasive grains of the agglomerated abrasive grain granules comprise at least one abrasive grain type selected from the group consisting of fused alumina, non-filamentary sintered sol-gel alumina, sintered bauxite, cofused alumina-zirconia, sintered alumina-zirconia, silicon carbide, cubic boron nitride, diamond, flint, garnet, boron suboxide, aluminum oxynitride, and combinations thereof.

7. The bonded abrasive tool of claim 1, wherein the abrasive grains of the agglomerated abrasive grain granules comprise fused alumina.

8. The bonded abrasive tool of claim 1, wherein the bond component and binding material each independently comprise an inorganic material selected from the group consisting of ceramic materials, vitrified materials, vitrified bond compositions and combinations thereof.

9. The bonded abrasive tool of claim 8, wherein the binding material is a vitrified bond composition comprising a fired oxide composition of $SiO_2$, $B_2O_3$, $Al_2O_3$, alkaline earth oxides and alkali oxides.

10. The bonded abrasive tool of claim 1, wherein the agglomerated abrasive grain granules have a size dimension in a range of between about two and twenty times larger than the average grit size of the abrasive grains of the agglomerated abrasive grain granules.

11. The bonded abrasive tool of claim 10, wherein the agglomerated abrasive grain granules have a diameter in a range of between about 200 and about 3,000 micrometers.

12. The bonded abrasive tool of claim 1, wherein the bond component is a resin bond.

13. The bonded abrasive tool of claim 1, wherein the agglomerates include a second binding material.

14. The bonded abrasive tool of claim 1, wherein the total amount of non-filamentary abrasive grains present in the bend is less than or equal to 25% of the weight of the blend.

15. The bonded abrasive tool of claim 13, wherein the bond and the second binding material each independently comprise an inorganic material selected from the group consisting of ceramic materials, vitrified materials, vitrified bond compositions and combinations thereof.

* * * * *